US008094022B2

(12) United States Patent
Goodman et al.

(10) Patent No.: US 8,094,022 B2
(45) Date of Patent: Jan. 10, 2012

(54) ACTIVE ID TAGS FOR INCREASED RANGE AND FUNCTIONALITY

(75) Inventors: Rodney M Goodman, South Pasadena, CA (US); Barry Edward Ambrose, Pasadena, CA (US)

(73) Assignee: InfinID Technologies, Inc, Pasadena, CA (US)

( * ) Notice: Subject to any disclaimer, the term of this patent is extended or adjusted under 35 U.S.C. 154(b) by 485 days.

(21) Appl. No.: 12/236,455

(22) Filed: Sep. 23, 2008

(65) Prior Publication Data

US 2009/0102656 A1 Apr. 23, 2009

Related U.S. Application Data

(60) Provisional application No. 60/975,112, filed on Sep. 25, 2007.

(51) Int. Cl.
*G08B 13/14* (2006.01)

(52) U.S. Cl. ..... 340/572.1; 340/10.1; 235/375

(58) Field of Classification Search .... 340/572.1–572.8, 340/10.1; 235/375, 385
See application file for complete search history.

(56) References Cited

U.S. PATENT DOCUMENTS

| | | | | |
|---|---|---|---|---|
| 5,804,810 | A * | 9/1998 | Woolley et al. | 235/492 |
| 5,892,441 | A * | 4/1999 | Woolley et al. | 340/539.26 |
| 6,972,682 | B2 * | 12/2005 | Lareau et al. | 340/568.1 |
| 7,145,451 | B2 * | 12/2006 | Ward, Jr. | 340/506 |
| 7,199,716 | B2 * | 4/2007 | Shanks et al. | 340/572.1 |
| 7,295,114 | B1 * | 11/2007 | Drzaic et al. | 340/572.1 |
| 2007/0252696 | A1 * | 11/2007 | Belisle et al. | 340/572.1 |
| 2008/0122610 | A1 * | 5/2008 | Muirhead | 340/505 |
| 2008/0211630 | A1 * | 9/2008 | Butler et al. | 340/10.1 |
| 2008/0244739 | A1 * | 10/2008 | Liu et al. | 726/22 |

* cited by examiner

*Primary Examiner* — Eric M Blount
(74) *Attorney, Agent, or Firm* — Law Office of Scott C Harris

(57) ABSTRACT

An RFID tag that uses multiple components to both receive and send information.

14 Claims, 3 Drawing Sheets

ACTIVE ID TAGS FOR INCREASED RANGE AND FUNCTIONALITY

This application claims priority from Provisional application Ser. No. 60/975,112, filed Sep. 25, 2007, the entire contents of which are herewith incorporated by reference.

BACKGROUND

RFID devices, e.g., RFID "tags" can be used to receive information from certain items such as for example keeping track of inventory and maintaining locations of certain items.

SUMMARY

The present application describes item to item networking for active tag RFIDs.

Another aspect of the system describes a special kind of system for interfering or interacting between the different RFID items.

BRIEF DESCRIPTION OF THE DRAWINGS

These and other aspects will now be described in detail with reference to the accompanying drawings, wherein.

DETAILED DESCRIPTION

RFID sensors, also called RFID "tags", have communicated typically via line of sight communication. A tag communicates directly with a remote interrogator. However, the inventors noticed that this creates a problem when the line of sight is blocked by some RFID attenuator material such as a metal, liquid or dampness. It also can create a problem when there is too large a distance between the tag and the interrogator.

According to the present invention, an active RFID device may relay other RFID information so that the interrogator may receive responses via relays.

This creates the ability to use RFID's for more robust scenarios, as described herein.

According to the present system, RF ID communicators are "meshed" to work reliably and securely even in the presence of barriers and at larger distance from interrogators.

Figure 1:
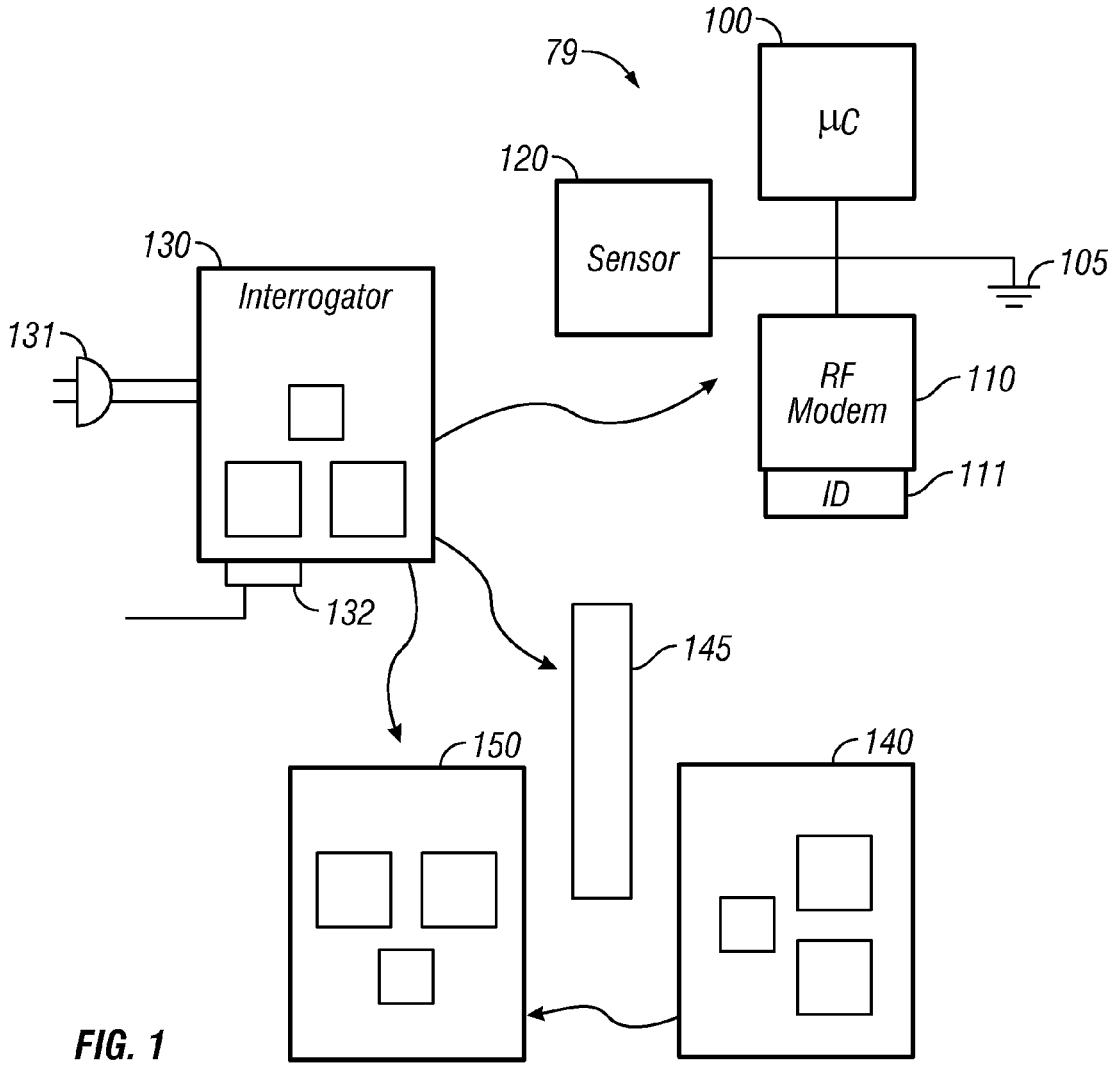
FIG. 1 illustrates a block diagram of the RFID tags and interrogators.

An embodiment of the tag may be as shown in FIG. 1. Each tag may include a microcontroller 100, communicating with an RF modem 110. The RF modem 110 may operate at 915 MHz, or at some other unlicensed frequency such as 433 MHz, 868 MHz or 2.4 GHz. Some optional sensors may be included such as shown by 120, or alternatively, these can be included as part of either the microcontroller chip or the RFID chip. These other sensors may also be included. These can include temperature sensors; humidity sensors; battery condition sensors and/or shock accelerometer, for example. RF modem 110 may include an ID 111 which may be a unique ID that identifies the RFID tag to all other aspects of the system. For example, the RFID address 111 may be a unique number, that represents the RFID tag.

An interrogator 130 shown, where the interrogator is in essence very similar to the other RFID tags. The interrogator may be precisely the same as the first tag 99, however, the interrogator 130 may operate from line power shown as 131 instead of from the battery power shown as 105. The interrogator may also include an ethernet port 132 to report the received data.

FIG. 1 also shows an additional RFID tag 140 which is blocked or partially blocked by an obstruction 145. According to this embodiment, the interrogator 130 may attempt to read the information from the RFID tag 140. However, it is unable to do so because of the barrier 145. However, RFID tag 140 communicates with RFID tag 150. When the interrogator polls 150 it receives the information from both the RFID tag 140 and also from RFID tag 150.

In an embodiment, the microcontroller 100 controls the modem 110 to receive all tags within range, and to send, responsive to a interrogation, information about all the RFID tags within range as well as its own information.

The system may use deterministic techniques to forward the message—broadcast routing or flooding routing to forward the information. In order to avoid the redundant routing caused by these techniques, probabilistic routing can be used. In general, for any node x, when the node x receives a broadcast message from another node y, it computes distance from x to y based on signal strength, propagation model and transmission power, area and signal strength, and uses a base probability p to decide how to rebroadcast the message with a real probability p', according to a function of all these parameters. This can minimize the amount of retransmission.

Figure 2:
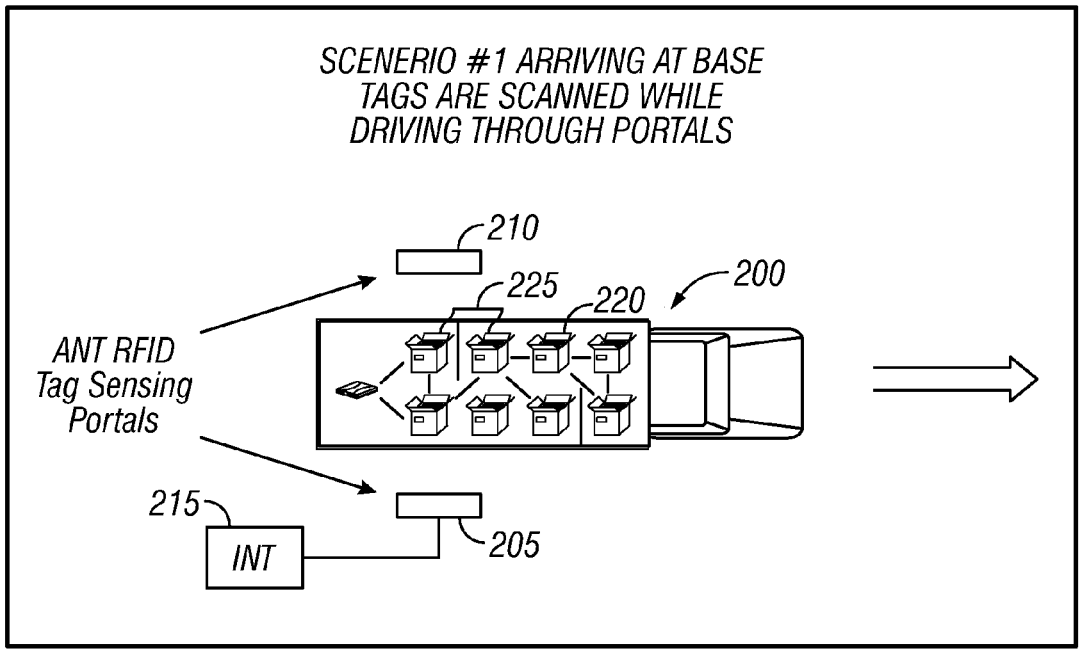
FIG. 2 shows the use of an RFID tag or interrogator to interrogate the contents of a truck.

FIG. 2 shows a first scenario, where items arriving at a base are scanned while driving through portals. For example, FIG. 2 shows a truck 200 arriving through a "portal". The portal includes two different sensors 205, 210.

As the truck 200 moves through the portal, each of the many different tags such as 220 are interrogated by the portal, either directly, or through a proxy. According to one embodiment, the truck may include a special proxy tag 225 located extending through the wall of the truck. This proxy tag may be another tag assembly like 99 that relays the information received from inside the truck bed to the scanner such as 210.

Figure 3:
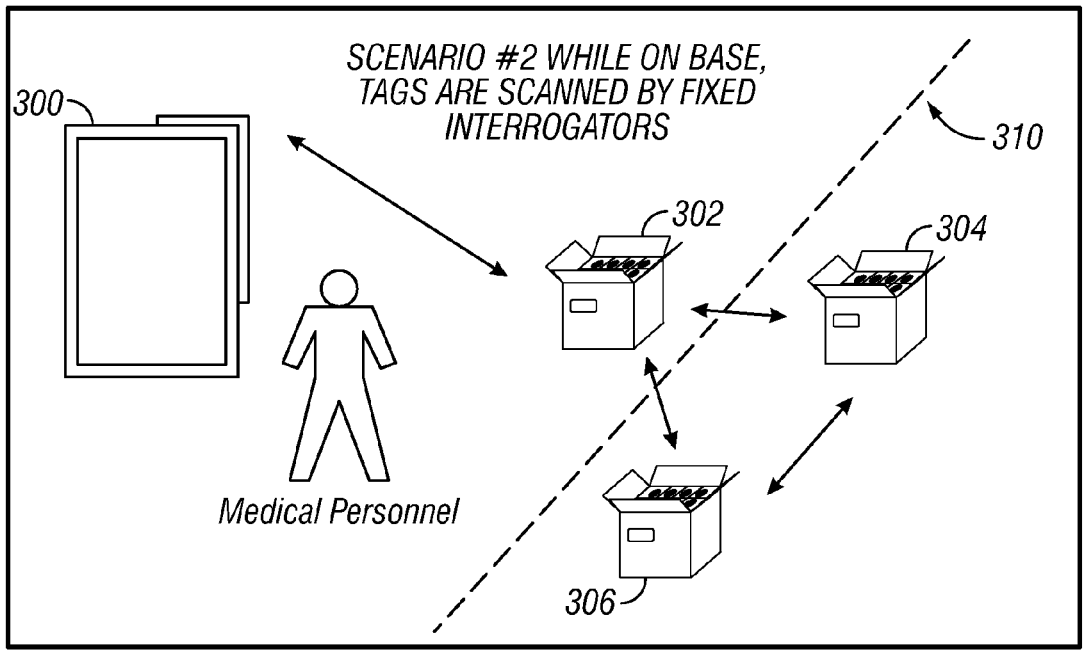
FIG. 3 shows RFID tags being scanned by fixed interrogators.

FIG. 3 illustrates another embodiment, where tags are scanned by fixed interrogators. A fixed interrogator 300 may scan any of the tag such as 302, 304, 306. In the embodiment, both 304 and 306 are outside of the lines 310 which represents the outer limits of scanning of the interrogator 300. Both of these are scanned via interaction with the tag 302.

Figure 4:
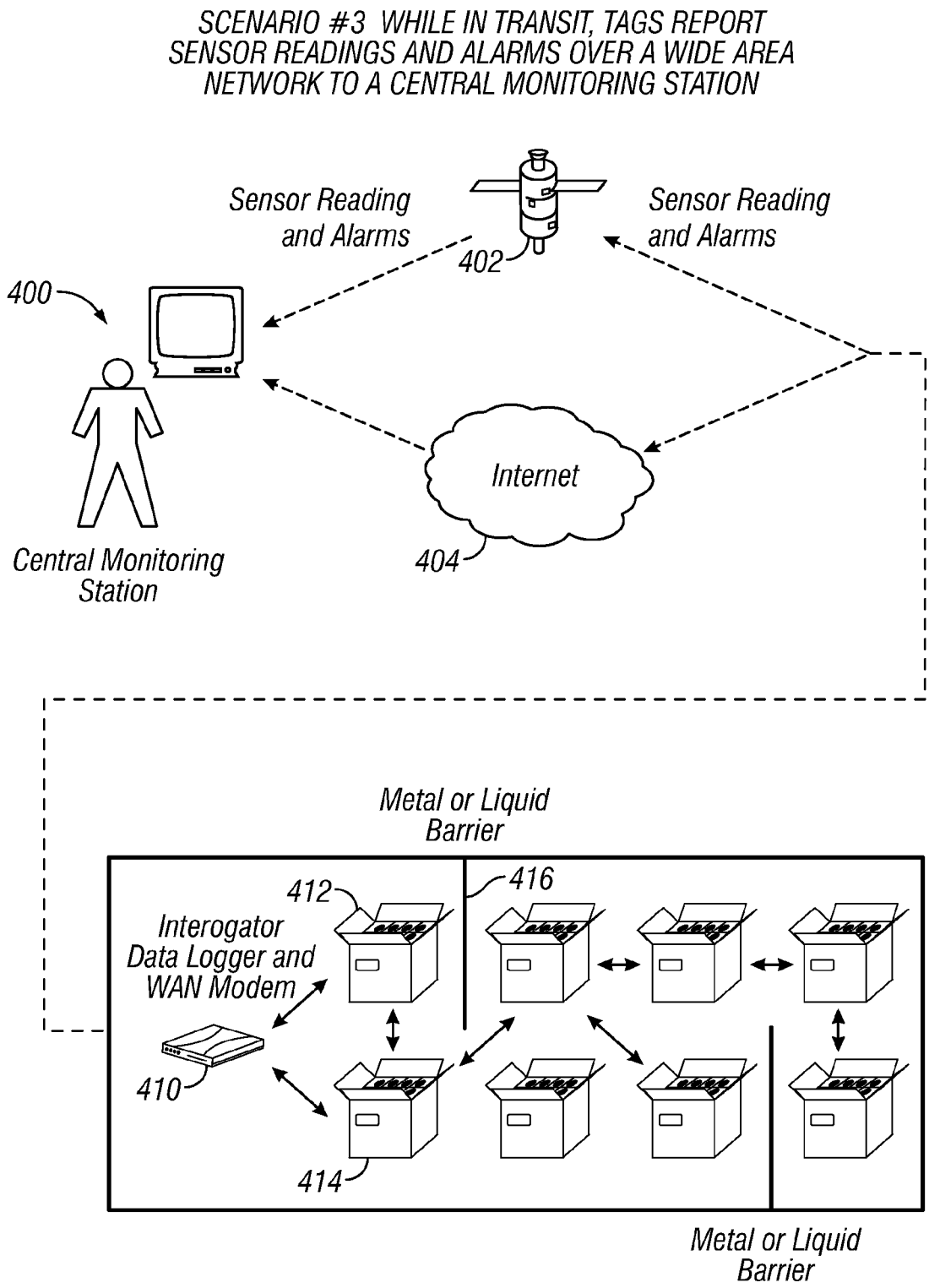
FIG. 4 shows different ways in which the RF ID tag can have its data and contents scanned and sent over long distances.

FIG. 4 illustrates an alternative embodiment in which a general monitoring station 400 may monitor the tags over a channel. 402 illustrates the channel being a satellite while 404 illustrates the channel being the Internet. The monitoring may be done by an interrogator 410, which can interrogate directly such as it does with 412, or through a proxy such as 414 in the presence of a metal or liquid barrier 416.

Advantages of the system include the following. First, the system may require less infrastructure in terms of readers and antennas. Tag IDs that are out of range of a reader can still be received by a reader field relay from other tags. The system is also more robust in terms of tag read rates and missed tags in current systems. This is because multiple tags like these are received by the reader via multiple diverse paths.

This also overcomes an effect known as the center box problem, in which tags on the inside of the pallet or case may be shielded from the direct line of sight to the reader. In this system, tags on the inside reach tags on the outside which do have line of sight. Their IDs are relayed to the reader.

In this system, because each tag is both a transmitter and receiver, the system can be made very secure by using challenge response encryption protocols. This allows the tag IDs to be verified as being genuine, and to verify that the system is not being spoofed. Also, since each tag inherently has an address, the tags can be read multiple times, from multiple different directions. This ability to read everything multiple times causes nearly 100% read rates with nearly 100% accuracy.

Figure 5:
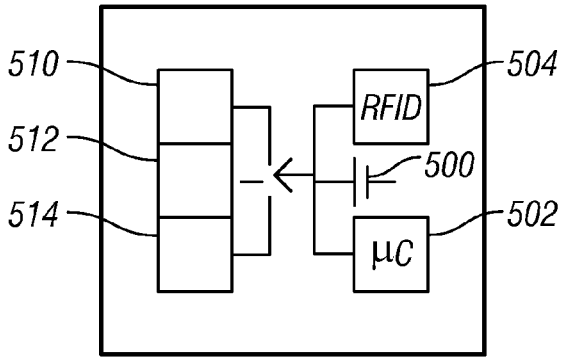
FIG. 5 shows an RFID tag with modular areas for extra sensors therein.

Another embodiment, shown in FIG. 5, allows the tags to have a new modular design. A battery, 500, controller 502, and RFID modem 504 may be the core elements in the system. An "open bus" design leaves spaces on the tag's surface itself. There may be one or more of such spaces; FIG. 5, for example shows five surfaces 510, 512, 514. These surface may include areas where items can be pressed in, or they may be areas for items that can be assembled with as part of the tag. For example, the tags spots can include any of the sensors described above.

The tags can be adhesive backed or simply plastic substrates of any given kind.

Although only a few embodiments have been disclosed in detail above, other embodiments are possible and the inventors intend these to be encompassed within this specification. The specification describes specific examples to accomplish~more general goal that may be accomplished in another way. This disclosure is intended to be exemplary, and the claims are intended to cover any modification or alternative which might be predictable to a person having ordinary skill in the art. For example, other sizes, materials and connections can be used.—the above has discussed how this can be used in RFID tags which include power supplies therein, so-called active RFID tags. In addition, however, this could be modified for use in passive RFID tags.

Also, the inventors intend that only those claims which use the-words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

What is claimed is:

1. An RFID assembly, comprising:

a first part, which includes a unique address indicative of an RFID tag and RFID information associated with said RFID tag;

a second, RFID modem, associated with said first part, which both receives first information from other RFID modems and also sends information in response to an interrogation directed to said unique address;

wherein said RFID modem sending said first information received from other RFID modems, and also sending said RFID information—in response to an interrogation; and wherein said RFID modem carrying out a probabilistic routing that determines, when said second RFID modem receives a message from at least one other RFID modem, a distance between said second RFID modem, and said at least one other RFID modem, and where said second RFID modem calculates, based on said distance, a probable signal strength to said at least one other RFID modem, a propagation and a transmission power to said at least one other RFID modem, and wherein said probabilistic routing determines a probability of successful transmission to said at least one other RFID modem to determine whether to rebroadcast the message based on said probable signal strength, propagation and transmission power.

2. A tag as in claim 1, further comprising a microcontroller, controlling operation of said second RF modem to send and receive information.

3. A tag as in claim 1 further comprising a sensor, which senses at least one characteristic of its environment, wherein said second RF modem sends information indicative of the sent characteristics.

4. A tag as in claim 1, further comprising a substrate, holding said tag.

5. A tag as in claim 4, wherein said substrate comprises an attachment part that allows the tag substrate to be attached to a support.

6. A tag as in claim 1, further comprising an interrogator for the tag, wherein said interrogator includes a source of AC power.

7. A tag as in claim 4, wherein said substrate includes an extra spot which can hold additional active portions.

8. A tag as in claim 1, wherein said tag relays messages from other tags.

9. A method comprising:

on an RFID tag, receiving information from other RF tags; and sending both information from other RFID tags, and also information indicative of the RFID tag's own information; and wherein said sending comprising a probabilistic routing that determines, when said RFID tag receives a message from at least one other RFID tag, a probable distance between said RFID tag and said at least one other RFID tag, and where said RFID tag calculates, based on said distance, a probable signal strength to said at least one other RFID tag, a propagation and a transmission power to said at least one other RFID tag, and wherein said probabilistic routing determines a probability of successful transmission to said at least one other RFID tag to determine whether to rebroadcast the message based on said probable signal strength, propagation and transmission power.

10. A method as in claim 9, further comprising a microcontroller, controlling operation of said RF modem to send and receive information.

11. A method as in claim 9 further comprising sensing at least one characteristic of an environment of the RFID tag, and sending information indicative of the sensed characteristic.

12. A method as in claim 9, further comprising mounting electronics on a substrate.

13. A method as in claim 12, wherein said substrate includes an extra spot which can hold additional active portions.

14. A method as in claim 9, wherein said tag relays messages from other tags.

* * * * *